US005431213A

United States Patent [19]

Jouet-Pastre

[11] Patent Number: 5,431,213

[45] Date of Patent: Jul. 11, 1995

[54] METHOD FOR AUTOMATED INJECTION OF GAS INTO AN INSTALLATION FOR MULTIPLE STRAND CASTING OF METALS USING THE HOT TOP PROCESS

[75] Inventor: Laurent Jouet-Pastre, Grenoble, France

[73] Assignee: Aluminium Pechiney, Courbevoie, France

[21] Appl. No.: 149,933

[22] Filed: Nov. 10, 1993

[30] Foreign Application Priority Data

Nov. 23, 1992 [FR] France ..... 92 14277

[51] Int. Cl.[6] ..... B22D 11/14; B22D 11/00

[52] U.S. Cl. ..... 164/420; 164/472

[58] Field of Search ..... 164/452, 451, 489, 464, 164/465, 472, 475, 154, 420, 487

[56] References Cited

U.S. PATENT DOCUMENTS

| | | | |
|---|---|---|---|
| 3,358,743 | 12/1967 | Adams | 164/420 |
| 4,157,728 | 6/1979 | Mitamura et al. | 164/452 |
| 4,986,337 | 1/1991 | Soulier | 164/420 |
| 5,170,838 | 12/1992 | Theler et al. | 164/452 |

FOREIGN PATENT DOCUMENTS

| | | | |
|---|---|---|---|
| 0317450 | 5/1989 | European Pat. Off. | 164/420 |
| 0372946 | 6/1990 | European Pat. Off. . | |
| 891444 | 9/1953 | Germany | 164/420 |
| 58-352 | 1/1983 | Japan | 164/420 |
| 63-33153 | 2/1988 | Japan | 164/420 |

*Primary Examiner*—Kurt Rowan

*Attorney, Agent, or Firm*—Dennison, Meserole, Pollack & Scheiner

[57] ABSTRACT

A method for automated injection of gas into a casting installation including a large number of ingot molds each equipped with a refractory header. Gas introduction slots of particular dimensions are used, with a gas circuit comprising reservoirs R1 and R2, flow meters FT1 and FT2, flow regulators, pressure regulators and valves, so disposed that the components of the system are able to maintain a suitable gas pressure over the ingot molds, detect any failure in any ingot mold and be able to check the condition of the slots after casting.

4 Claims, 7 Drawing Sheets

METHOD FOR AUTOMATED INJECTION OF GAS INTO AN INSTALLATION FOR MULTIPLE STRAND CASTING OF METALS USING THE HOT TOP PROCESS

FIELD OF THE INVENTION

The present invention relates to a method for the automated injection of gas into an installation for the multiple casting of metals and equipped with ingot molds which have a refractory header.

One skilled in the art of foundry work, particularly in connection with aluminum and its alloys, knows well, particularly from the teaching of U.S. Pat. No. 3,381,741 that with a view to improving the quality of cast products and more particularly for improving the near surface structure, it is possible to use hot top casting which consists in positioning over the ingot mold a refractory header inside which the metal emanating from a supply channel remains in the liquid state before passing into the cooled ingot mold where it solidifies in the form of billets. The refractory header projects inwardly of the inner wall of the mold, so that an overhanging portion is formed.

In the English language, this technique is referred to as "hot top" casting and since its creation it has been the subject of various improvements such as the injection of gas into the ingot mold just below the overhang and all around the column of metal which is still in the liquid state.

Such an improvement was described in U.S. Pat. No. 4,157,728 which stipulates also that the gas is injected through a slot measuring 0.05 to 0.7 mm at a pressure close to metallostatic pressure at the level of the overhang and that its flow rate is regulated as a function of the mold temperature and the pressure is within a range of values between 0.2 and 5 liters/minute, the flow rate being increased when the temperature and/or the pressure increases, and vice versa.

Furthermore, it is stipulated in the examples that the height of metal in the refractory header is still less than or equal to 100 mm and that in addition to the gas, there is continuously introduced into the ingot mold a lubricant of which the flow rate may be related to that of the gas.

Within the framework of the improvements, European Patent No. 449,771 likewise describes, in an installation comprising a plurality of ingot molds with a refractory header, equipped with a continuous supply of lubricant, a casting process which is characterized in that air or an inert gas at a slight overpressure is introduced identically into all the ingot molds by means of a main pipe having a plurality of distributing pipes, the relative pressure between the desired value calculated by a programmer as a function of the level of metal H1 detected by a level gauge and the effective value measured in the piping by means of a pressure transducer is used for regulating and monitoring, the monitoring function being performed by a processor by the emission of a signal to an actuator which controls a pressure regulating valve positioned on the piping.

Within the framework of multiple casting with a refractory header and automated gas injection, the Applicants' objective was to perfect a method which could be applied in the case of a compact installation and which did not necessarily call for a continuous supply of lubricant.

A compact installation is an installation in which a great number of ingot molds are used per unit of ground surface area.

Compactness is already a very interesting characteristic feature in the case of a new installation because it makes it possible to reduce installation costs.

But it is a really vital characteristic feature in the case of renovation of existing installations, as the following examples show.

A first and very frequent case of renovation consists of replacing the casting process known as "conventional" where the ingot molds are supplied with metal by spout and float on an existing installation by a hot top casting process which offers a certain number of well-known advantages over the conventional method. Naturally, this renovation operation does not have to be accompanied by a reduction in production capacity. The tables of the conventional casting method are very compact and the casting pits which they serve are consequently of very small size in general. It is therefore vital in this case to have available a hot top casting method which offers great compactness.

Another likewise frequent case of renovation consists of increasing the production capacity of the casting installation either in order to accompany the increase in the capacity of a furnace or in order to improve the rate of use of an existing furnace. In this case also compactness is a prime feature in the choice of casting method.

Compactness is achieved by bringing the ingot molds very close to one another. With this arrangement, the casting channels which convey the liquid metal are necessarily placed above the molds, as with conventional casting, and not beside them as happens with numerous hot top casting methods. This arrangement leads to an increase in the metallostatic pressure in the ingot molds, the pressure generally corresponding to a height of metal of more than 200 mm in the refractory header.

On the other hand, the fact of being able to do without a continuous supply of lubricant constitutes a vital bonus where problems of treating casting water are concerned.

Indeed, where there is a continuous supply of lubricant, the major part of this lubricant finds its way into the casting water. If this casting water circulates in a closed circuit, it is necessary to eliminate the lubricant content in order to avoid a progressive enrichment with lubricant which would have catastrophic consequences for the water circuit itself and for the cooling of the cast billets. If the water circuit is open, it is necessary to eliminate the lubricant contained in the water downstream of the casting pit in order to comply with the hydrocarbon rejection standards which are increasingly more restrictive.

With no continuous lubricant supply, water treatment is far simpler and therefore far less expensive, both in terms of investment and also in terms of running costs. It can possibly be omitted in the case of an open circuit.

The problem which faced the Applicants was first to render this compactness and this lack of need for continuous supply of lubricant compatible with gas injection, and second to have an automated gas injection easy to operate.

The metallostatic pressure conditions imposed by compactness give rise to particular difficulties in the achievement of gas injection through a slot such as that described in U.S. Pat. No. 4,157,728 and these difficulties are aggregated when a continuous lubricant supply is not used.

On account of the considerable metallostatic pressure, the liquid metal can infiltrate the slot and solidify. The resulting small solid point, clinging securely in the slot, causes a defect on the surface of the cast billet and this could possibly be serious with regard to the billet quality and operator safety (vertical drag, hot tear, bleed out).

This tendency towards infiltrations of metal and sticking is accentuated in the absence of a continuous supply of lubricant; there is not a permanent and constantly renewed presence of oil in front of the entrance to the slot which is capable of arresting infiltration and limiting adhesion of the metal.

Under these conditions, it is vital either to use an extremely fine slot, smaller than 0.08 mm, or to forego injection through a slot and adopt injection via a porous material, the porosities of which are even finer.

But the use of a very fine slot, like any use of a porous material, poses further problems, this time in connection with the control of gas injection.

The function of the injected gas is to balance the metallostatic pressure at the level of the meniscus formed by the metal in the angle constituted by the ingot mold and the overhang of the refractory header. The basic physical parameter of injection is therefore the gas pressure behind meniscus.

In order to maintain this pressure, it is possible to inject the gas at a fixed rate, as in U.S. Pat. No. 4,157,728.

However, experience shows that it is very difficult to fix the flow rate and this difficulty is greatly accentuated in the case of a compact casting installation with a high metallostatic pressure.

This difficulty will be more clearly understood by analyzing the manner in which the injected gas is consumed.

The kind of small annular chamber, the walls of which are constituted by the meniscus, the ingot mold and the overhang and into which the gas is injected through the slot is not sealing-tight. Normally, the gas escapes through the meniscus-ingot mold interface (vertically downwards).

But there may also be other points of escape which are as many parasitic leakages:

gas bubbles which pass through the liquid metal if the pressure behind the meniscus exceeds the metallostatic pressure;

leaks through the refractory header due to the fact that it is of porous material and may be cracked;

leakages in the gas supply circuit upstream of the annular chamber.

In total, the gas consumption is variable. Fluctuations are imputable in one part to the parasitic leakages and in another part to the variable and random nature of the meniscus-ingot mold contact. The sealing-tightness of this interface depends on three principal parameters which are the surface roughness of the ingot mold, the surface roughness of the cast billet and the lubricant placed between the two which also plays an important part. These three main parameters are themselves a function of many other factors. For example, the surface roughness of the billet depends on the composition of the alloy and the casting parameters which include metal temperature and even gas pressure.

The difficulty in fixing a flow rate in order to obtain the desired pressure behind the meniscus is therefore a very real one.

The way difficulties are amplified when the metallostatic pressure is increased, because of the parallel increase which has to be imposed on the gas pressure.

By reason of this higher gas pressure, the fluctuations in gas consumption are greater. For example, the divergence becomes even greater between:

a strand with a high level of parasitic leakages and a strand with a low level of parasitic leakages;

the hottest strands and the coldest strands on the casting table;

a strand equipped with a new ingot mold and a strand equipped with a worn ingot mold where the roughness is not the same;

a commencement and a completion of casting, when there is no continuous lubrication.

Under these conditions, the adjustment of gas pressure by actuating a flow rate becomes quite random.

Having regard to this fact, the best way of managing the method consists in regulating the gas pressure, this pressure being measured in the annular chamber, behind the meniscus.

But practically, a simultaneous measurement at this point and in all the ingot molds proves impossible so that it becomes necessary to move the measuring point more upstream in the gas supply circuit.

Then one comes up against a problem of head loss. Every gas circuit generates head loss when a gas flow goes through. It is generally considered that head loss depends on flow rate, the ratio between head loss and flow rate being called head loss coefficient. The head loss problem concerns the gas circuit which supplies the mold. Two cases can be distinguished considering the head loss level in the gas circuit.

In the first case, head loss is significant. So the measured pressure and the pressure behind the meniscus are not identical, and the relationship between the two values becomes very complex.

To adjust the pressure behind the meniscus, it is necessary not only to control the upstream pressure at the measured point, but also to monitor the gas flow rate and the head loss coefficient (because gas flow rate fluctuates, and head loss coefficient may develop in time). This is relatively complicated.

Furthermore, it is extremely difficult to forecast what would be the optimized pressure set point value to be applied at the pressure measurement point. This set point value has to be determined empirically and must be taken up directly as soon as there is the slightest change in the process, whether this is desired (if there is a change in the casted alloy) or sustained (if there is an evolution in the head loss coefficient due to an aging of the tooling).

So, in this case, there is no advantage in using pressure in relation to flow rate as controlling parameter.

In the second case, head loss is not significant (what will be further described as "zero head loss"). Then the measured pressure and the pressure behind the meniscus are equal and it is possible to work with the first pressure exactly as if it were the second one.

This case therefore makes it possible for direct control via gas pressure. Nevertheless this case is incompatible with gas injection via a porous body instead of a slot.

Passage through the porous body creates a high level of head loss and makes it necessary to use the flow rate as the controlling parameter.

Moreover, gas injection via a porous body makes obligatory the use of a continuous lubrication for the mold (the emergence of the gas through the porous body expels the lubricant which is in front and which therefore must be continuously renewed).

Indeed, zero head loss is only compatible with gas injection through a slot and even then it is subject to two conditions.

The first is that the slot should be of sufficient thickness. Calculations and experience show that a thickness in excess of 0.05 mm is needed, even more according to the flow rate, in order not to have significant head loss during passage through the slot.

The second one is that the flow rate must be limited to fairly low levels (maximum 100 Nl/h) to ensure that the head losses, which we know increase with the rate of flow, remain insignificant over the entire gas supply circuit downstream of the measurement point. In particular, this means that one must absolutely avoid any parasitic leakage in the case of a strong metallostatic charge, where, having regard to the elevated gas pressure, leakages suddenly become very important, which considerably increases the flow rate passed to the ingot mold and therefore the head loss.

Taking into account the objectives which were set for them and the constraints arising therefrom, the Applicants therefore had no other choice than to turn to an injection device involving a slot but with very substantial difficulty of having to avoid the two obstacles which are on the one hand the infiltrations of metal and on the other the appearance of significant head loss in the gas circuit.

Thus, it is necessary to have available a gas supply circuit which makes it possible in addition to the obvious function of pressure control, to carry out a certain number of monitoring and command procedures such as:

outside of the casting operation, monitoring of the head loss corresponding to a reference flow rate on each strand gas supply. This monitoring function makes it possible to verify the thickness of the slot and/or the extent to which it is clogged;

outside the casting operation, monitoring of the level of parasitic leakages over the various parts of the circuit;

during casting, the possibility of closing off the gas supply on each flow individually in order to avoid any parasitic leakage in the case of a strand being inoperative either voluntarily or by necessity (strand blocked by reason of a substantial bleed out). This command makes it possible to avoid upsets in the regulation of pressure generated by the enormous leakage which exists if the gas does not encounter the back pressure of the metal in a strand;

during casting, the possibility of spot measuring the gas flow rate on each strand. This monitoring function makes it possible to detect possible anomalies if the strand is outside the conventional ranges established by experience (parasitic leakages, defects in the tooling, defects on the cast product). It is all the more rich in information since it is related to monitoring of the head loss at the slot or even other data such as the age of the ingot mold.

Furthermore, in order to correctly manage the actual transient phases at the onset of casting, the gas supply circuit must make it possible:

to regulate the flow at the gas source (instead of regulating the pressure) during the filling phase of the ingot molds (the metal at the onset is not present and consequently the notion of counterbalancing the metallostatic pressure by the gas is without meaning);

to regulate in terms of pressure and to set it at a level higher than the steady state level for a brief period after casting start in order satisfactorily to unstick the metal from the ingot mold on the one hand and from the overhang on the other in order to form a meniscus with a wide radius guaranteeing a good surface quality of the cast billet.

It is in order to resolve all these problems that the Applicants perfected the process of the invention.

SUMMARY OF THE INVENTION

The invention is concerned with a method for automated injection of gas into an installation for multicasting of metals and comprising n ingot molds each surmounted by an overhanging refractory header and supplied with liquid metal via a channel situated above the ingot molds in such a way as to form a column of metal, in which method gas is injected into each ingot mold around the metal and just below said overhanging refractory header at a flow rate of D and at a pressure P close to that exerted by the column, via a slot which is horizontal and connected with a source of pressurized gas, characterized in that:

during casting, regulating the gas pressure P over all the ingot molds by connecting the gas source to the slots via a flow meter FT1 and a primary reservoir R1 provided with a pressure gauge PT1, filled with gas which is maintained at the pressure P by means of a pressure regulating valve PV1 situated upstream of R1 and downstream of which reservoir n pipes emerge, each being equipped with a valve VP and each connected to one of the slots;

during casting, controlling the overall flow rate of the installation via flow meter FT1 in order to detect any anomaly which is sufficiently great to have an effect on said flow rate;

on one or more occasions during casting operation, measuring successively over each ingot mold taken in isolation the flow rate which supplies it by connecting R1 to a reservoir R2 through a flow meter FT3 which creates only negligible head loss, said reservoir R2 being provided with n pipes each equipped with a valve VS and each connected to the pipes emerging from R1 downstream of the valves VP, and opening in turn each valve VS while closing the corresponding valve VP, said flow rate being read on the flow meter FT3 and making it possible to stipulate the origin of any anomaly previously detected by FT1 or to detect any strictly local anomaly;

prior to starting, applying a fixed flow rate Dd by means of FT1 and PV1, monitoring the pressure in R1 by means of PT1;

shortly after starting, applying a pressure $Pd > P$ by means of PT1 and PV1;

after the casting operation, as there is no more counter-pressure of metal, monitoring on each ingot mold taken in isolation, the thickness of the slot by means of a measurement of the head loss created in relation to a reference flow rate, by connecting R2 to the source of gas via the intermediary of a flow meter FT2 and a regulating valve FV2, by insulating R2 from R1, regulating the flow rate Dc to a fixed level, by successively opening each valve VS and by measuring in turn the pressure by means of a pressure gauge PT2 mounted on R2;

between two casting operations and after having isolated R1 from R2 and having closed all the valves VP, detecting a possible leakage on the primary part of the circuit by applying a pressure P' in R1 and by reading the flow rate on FT1; and between two casting operations, after having isolated R2 from R1 and having closed all the valves VS, detecting a possible leakage on the secondary part of the circuit by applying a pressure P' in R2 and by reading the flow rate on FT2.

This automated gas injection method is preferably interesting when applied to a casting installation in which:

the column of liquid metal contained in the ingot mold has a height of 200 to 250 mm, said height being measured from the base of the overhang;

the slot through which the gas is injected into each ingot mold is 0.05 to 0.08 mm in thickness;

the ingot molds are coated with grease only prior to casting;

the casting table has a great compactness, a casting table being compact when the formula is satisfied: $140<(E-l)<200$ (E and l expressed in mm), where E is the distance between the vertical axes of two molds next to each other on the casting table and l is the inside diameter of the molds.

Thus, this method makes it possible for the injection of gas to be automated in a compact installation which is not equipped with a continuous supply of lubricant.

Slots are used which have a width selected from a very narrow range in order to take into account the compromise between head loss and liquid metal infiltration.

Furthermore, recourse is had to the use of buffer tanks and the gas circuits are so designed that head losses are homogeneous among the various strands and are very low in relation to the pressure P at the level of the slots.

Under these conditions, the pressure level displayed at the level of the reservoir is virtually equal to the value of P prevailing at the level of the ingot mold.

This virtual equality between the pressure in the reservoir and the pressure in the ingot molds makes it possible:

very easily to determine the value of P if we know the height of metal in the channel; this value is in effect unaffected by other parameters such as the cast alloy, mold diameter, temperature, cast speed, mold taper, mold lubrication and mold roughness;

to carry out collective regulation of the gas in the ingot molds, which is very convenient both in terms of automation and also with regard to exploitation.

Furthermore, this method is very flexible in use: the gas supply may be cut off to one of the ingot molds or because the strand is not used or because the cast billet has been lost during the casting operation; it is possible at any given moment to apply an overall flow rate to the installation instead of applying a pressure, which is particularly useful before and during the time while the ingot molds are being filled with metal, so that there is no counter-pressure of the metal; it is likewise possible at any given moment to apply gas pressures in excess of metallostatic pressure at the moment of starting when the bubbling limit is intended to facilitate the change over from a solidification system with ripples or laps to a solidification system in which the meniscus is stable.

Numerous checks are possible during and after casting.

During casting:

the flow meter FT1 permanently measures the overall flow rate D. For one and the same mold diameter, the consumption of the ingot molds varies according to the cast alloy but also it varies from one ingot mold to another. The value and evolution of the overall flow rate therefore gives a good indication of proper overall operation of the installation. Thus, an abnormally elevated flow rate may be explained by leakages on the gas circuit or by a poor sealing-tightness in the billet-mold contact. Conversely, a reduction in the overall flow rate may indicate an improvement in the billet surface quality;

spot measurements on one ingot mold may provide interesting information concerning its state of operation. In particular, it is possible to diagnose abnormal leakages brought about either by failure of the gas circuit to this ingot mold or by more or less marked surface defects (roughness, vertical drags, hot tears, etc.) on the billet surface.

After casting:

measurement of head loss of each ingot mold is one way to monitor the thickness of the slot.

Indeed, the thickness of the slot diminishes progressively after each further casting operation, on the one hand because lubricant residues may clog the slot and on the other because these slots may vary in thickness due to the clamping effect between the ingot mold and the refractory header. This narrowing leads to an increase in the head loss linked with the slot. By measuring the head loss of an ingot mold after each casting, one has an idea of the evolution of the slot; this makes it possible not only preventively to change an ingot mold in which the slot is too narrowed but also to exploit more satisfactorily the individual measurements of flow rate. For example, a very low individual flow rate on one ingot mold does not have the same significance with a very narrowed slot as it does with a normal slot.

Measurements of leakage respectively on the primary circuit and on the secondary circuit make it possible to detect and therefore to resolve before the next casting a certain number of malfunctions. Indeed, it is of prime importance to insure that the injected gas will indeed go to the ingot molds.

BRIEF DESCRIPTION OF THE DRAWINGS

The invention will be more clearly understood from the attached figures in which.

DESCRIPTION OF THE PREFERRED EMBODIMENTS

Figure 1:
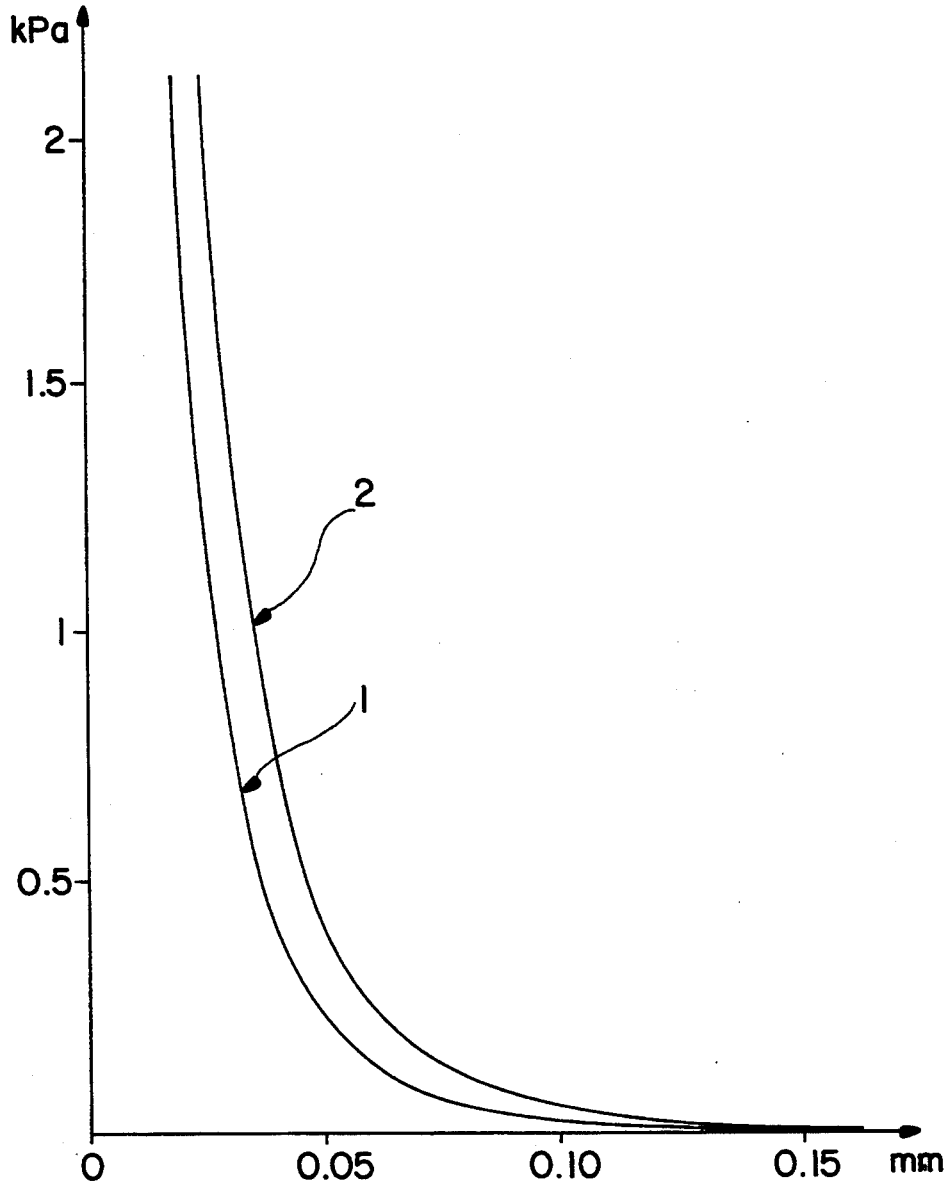
FIG. 1 is a diagram showing the head loss (measured in kPa) created by the slot in an ingot mold of diameter 254 mm as a function of the thickness of the slot measured in mm and various gas flow rates encountered during casting.

In a more detailed manner, FIG. 1 shows a curve 1 corresponding to a flow rate of 80 Nl/h and a curve 2 corresponding to a flow rate of 150 Nl/h. It is noted that over and above a threshold value for slot thickness situated towards 0.05 mm, the head loss increases very greatly when the thickness of the slot diminishes and it is therefore necessary to have a sufficient thickness without, however, exceeding a value above which the metal would too easily penetrate the slot.

Figure 2:
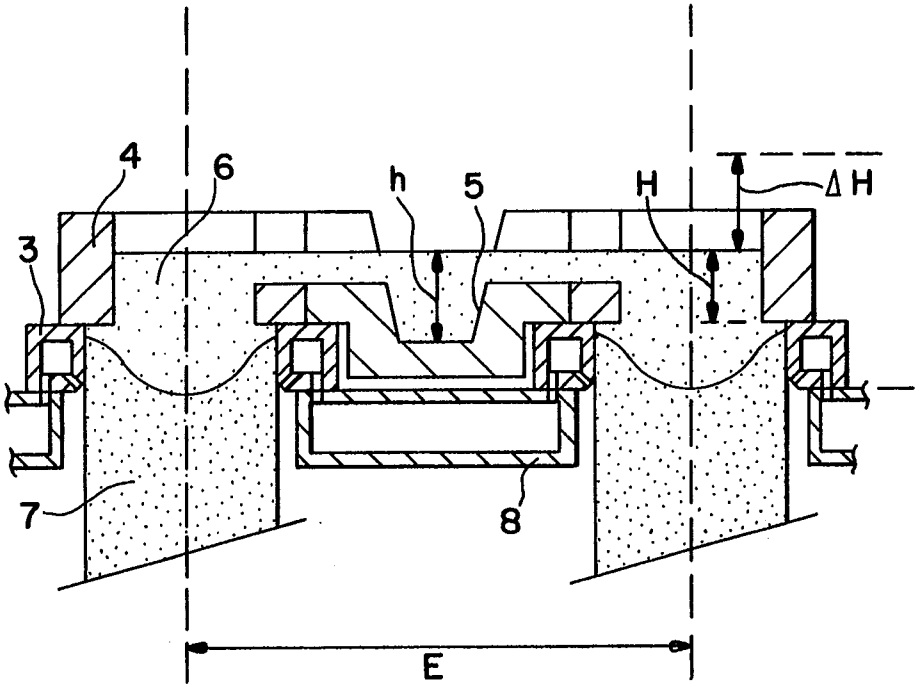

In FIG. 2 corresponding to an installation with a low density of ingot molds, it is possible to see two ingot molds 3 each surmounted by a refractory header 4 in relation to a distribution channel such as 5 conveying liquid metal 6 which solidifies in billets 7 under the cooling effect of the ingot molds which are supplied with water from source 8. Gas is injected into each ingot mold through a slot 19, located just below refractory header 4.

Figure 3:
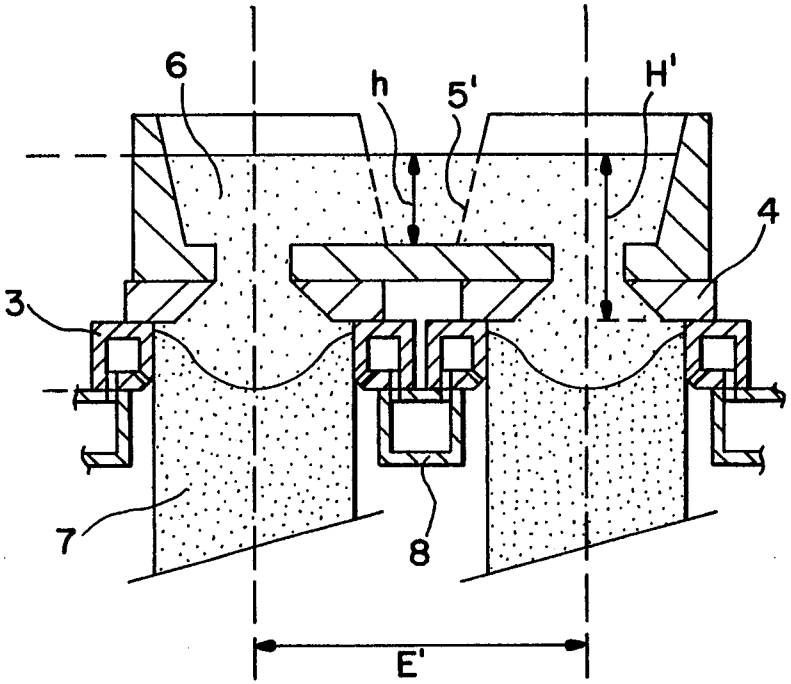
FIGS. 2 and 3 are sectional views of the arrangement of two ingot molds side by side, respectively, in an installation with a low density of ingot molds and in an installation with a high density of ingot molds.

The same references except for the channel which is designated 5', are used in FIG. 3 corresponding to an installation which is compact.

It can be seen that moving the ingot molds towards one another, which corresponds with a reduction of the distance E between centers, is achieved by raising and changing the channel 5. With disjointed ingot molds, the bottom of the channel can for practical purposes rest on the source 8. With ingot molds which are close to one another, the bottom of the channel 5' must necessarily be situated above the lower refractory header 4 which surmounts the ingot molds.

Furthermore, since the function of supplying and distributing metal to the various ingot molds remains unaltered between the two configurations, the central part of the channel 5' which does in fact satisfy this function, is required to retain the same cross-section and the same height of metal h as the corresponding part of the channel 5. The result is that the height of the column of metal situated above the ingot mold, H' in FIG. 3, is markedly greater than the height H in FIG. 2.

This difference between H and H' shown as $\Delta H$ in FIG. 2, is the reason for the increased gas pressure which has to be supplied in a compact installation such as that in FIG. 3.

Figure 4:
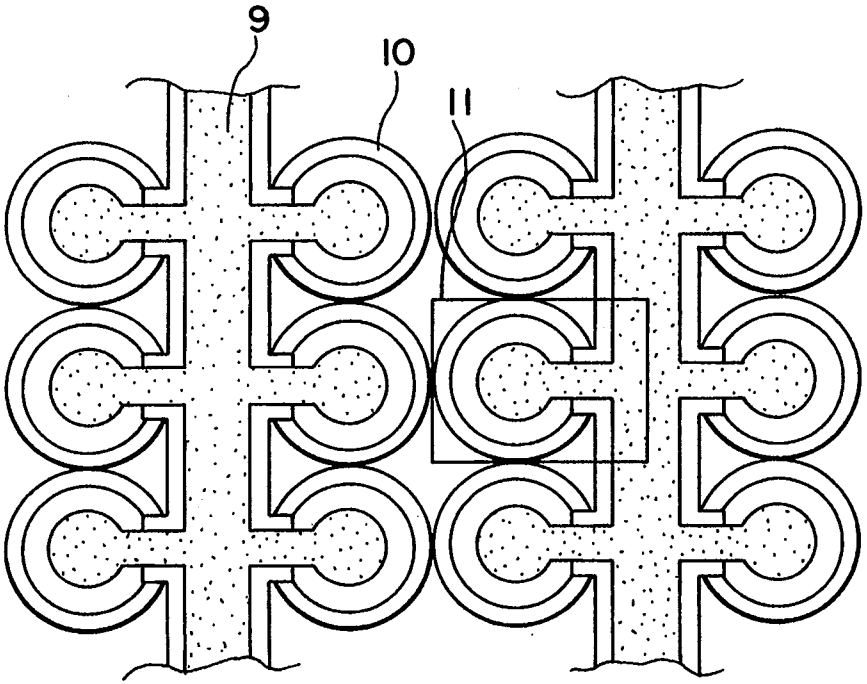

In FIG. 4, corresponding to a plan view of FIG. 2, is shown the channel 9 which supplies the ingot molds 10 each occupying an average horizontal surface area represented by the rectangle 11.

Figure 5:
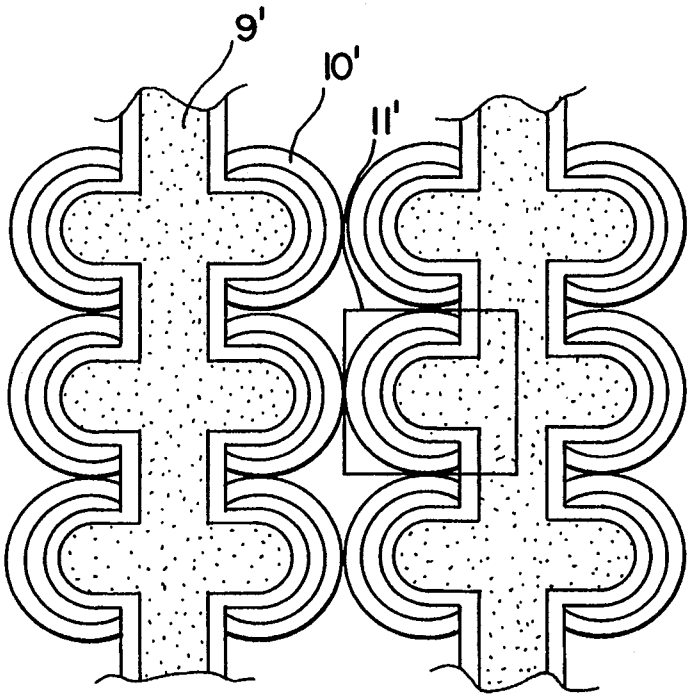
FIGS. 4 and 5 are plan views of two ingot molds according to FIGS. 2 and 3.

FIG. 5 which shows the same elements as in FIG. 4 shows that the surface area 11' occupied by an ingot mold is markedly smaller than the surface area 11. In order of magnitude, the density of ingot molds on a compact installation of the type in FIG. 5 is increased by 30 to 60% in relation to the density on a non-compact installation of the type shown in FIG. 4, this percentage being in particular a function of the ingot molds' diameter.

Figure 6:
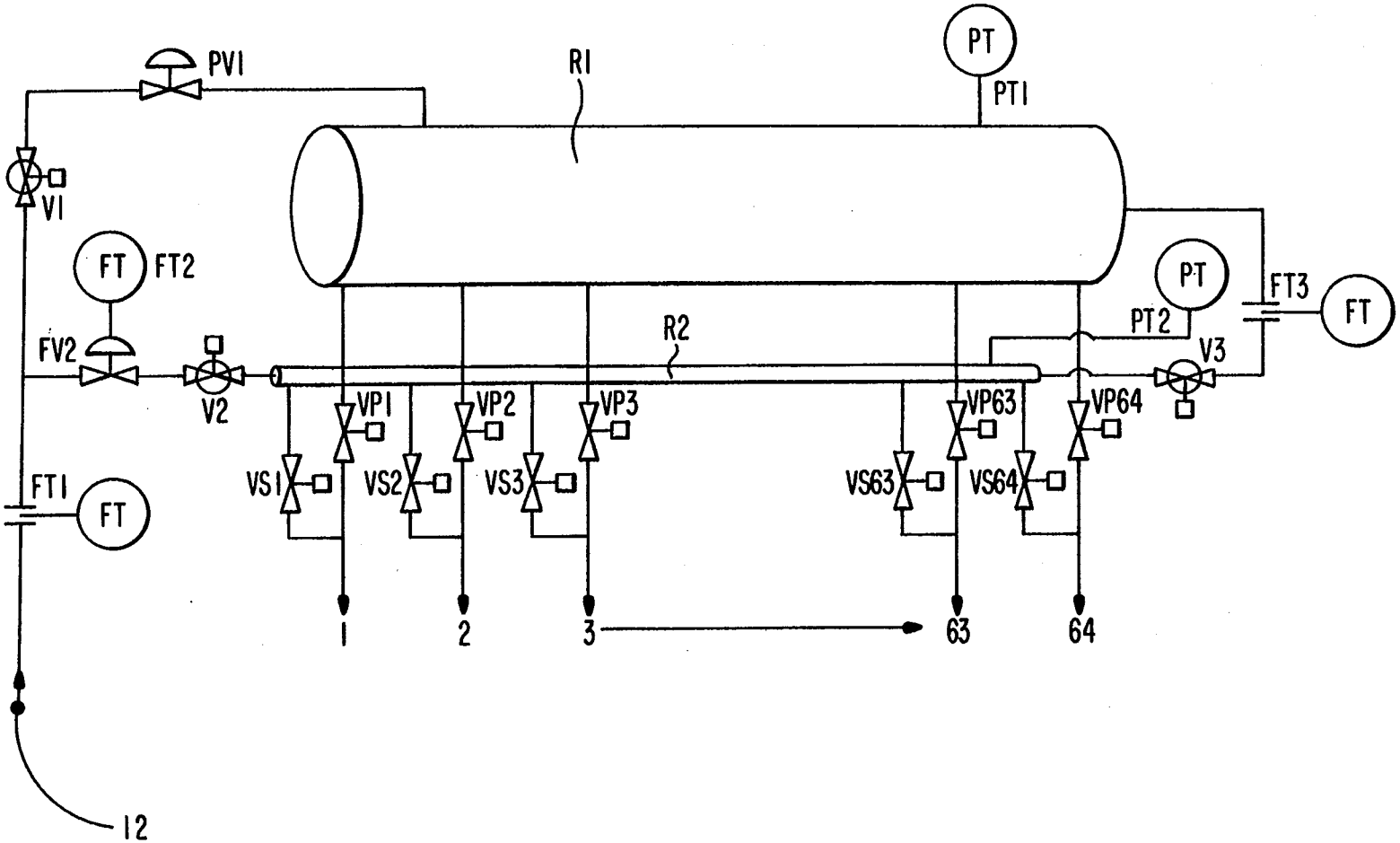
FIG. 6 is an overall diagram of the gas circuit.

FIG. 6 shows a general diagram of the gas circuit for an installation with 64 strands. It is possible to see the gas source 12, the flow meter FT1, the isolating valve V1, the regulating valve PV1, the pressure gauge PT1 placed on the primary reservoir R1 from which discharge the pipes supplying the ingot molds numbered 1 to 64 via the valves VP. Connected between FT1 and V1 through firstly the flow rate regulator consisting of the regulating valve FV2 and the flow meter FT2, then the isolating valve V2, the secondary reservoir R2 provided with a pressure gauge PT2 and from which 64 pipes emerge each fitted with a valve VS and which are connected to the pipes emanating from R1 downstream of the valves VP.

R1 and R2 are connected to each other by a flow meter FT3 and an isolating valve V3.

Figure 7:
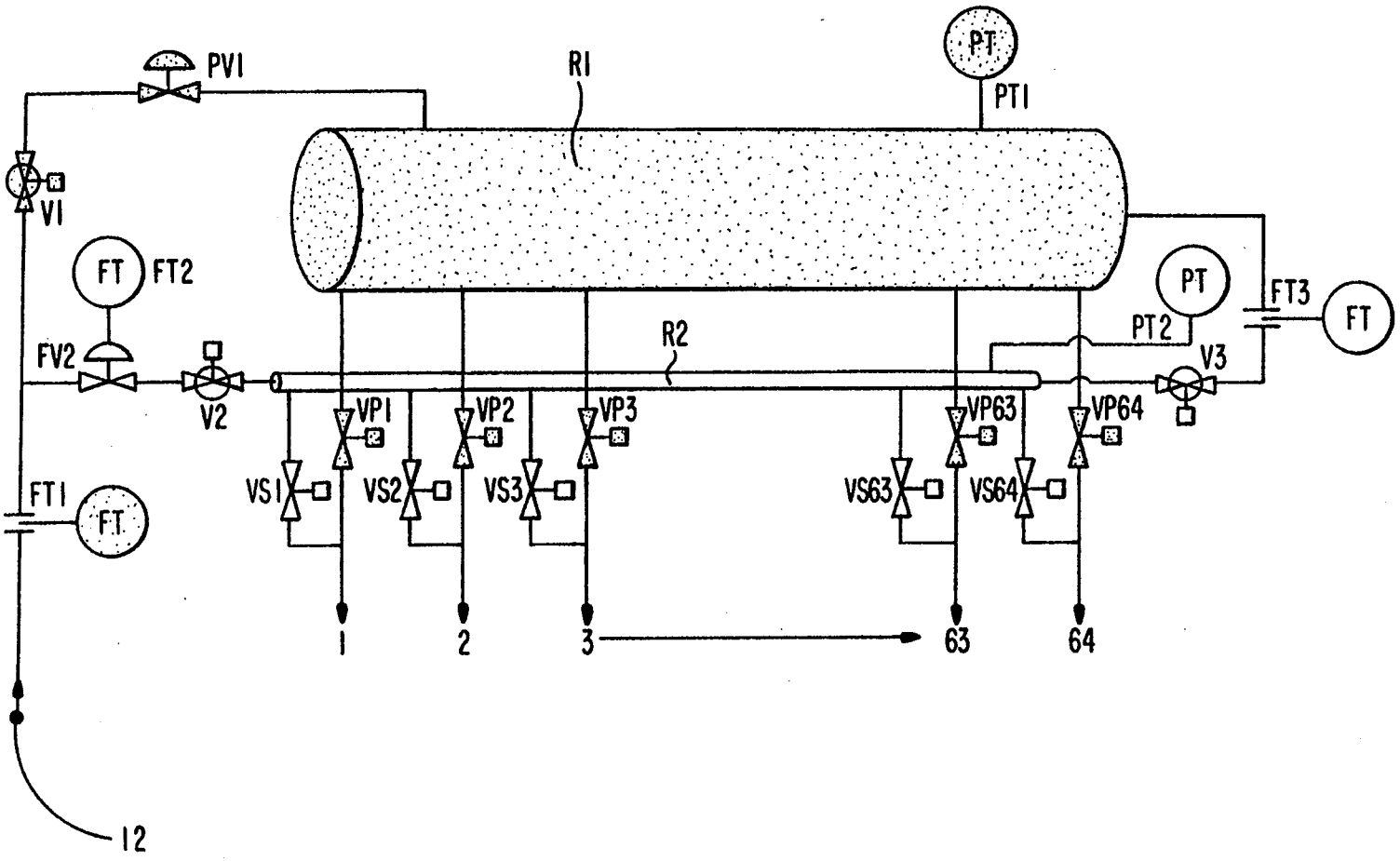
FIG. 7 is the same diagram showing in hatching the gas circuit during pressure regulation over all the ingot molds during casting operation.
Figure 8:
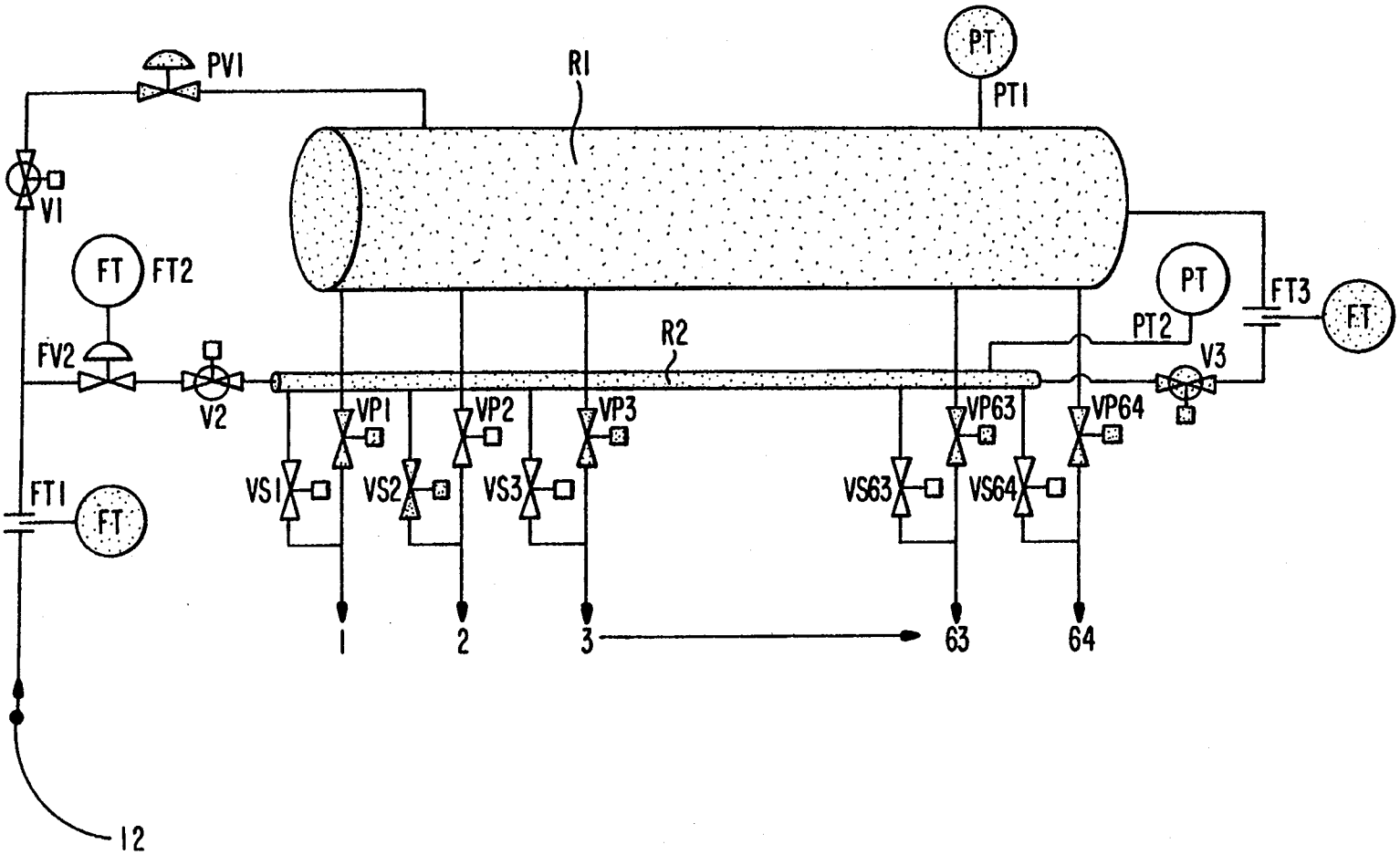
FIG. 8 shows the same diagram as in FIG. 6 but during flow rate measurement in the ingot mold No. 2, during casting operation.
Figure 9:
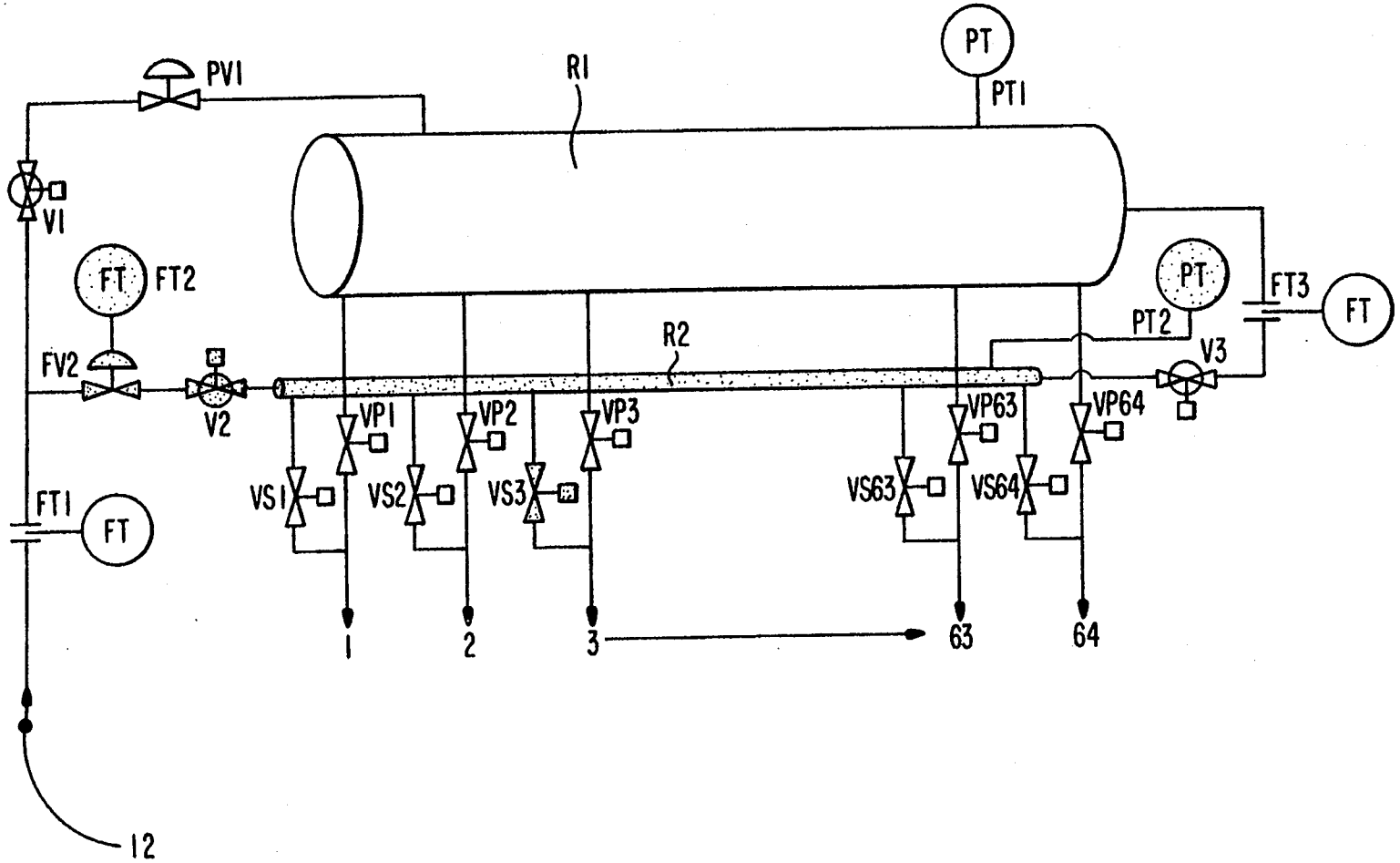
FIG. 9 is the same diagram as in FIG. 8 during head loss measurement on the slot No. 3 after casting.

In FIGS. 7, 8 and 9 we find the same elements; the only differences are the parts shown in hatching which correspond to the circuits used by the gas.

More particularly, in FIG. 7, which corresponds to the pressure regulation during casting operation, it can be seen that the flow of gas measured by the flow meter FT1 passes through the valve V1 and the regulating valve PV1 and fills R1. According to the divergence between the readings of the pressure gauge PT1 and the selected operating pressure, so automatic control acts more or less on the opening of the valve PV1 in order to cancel out this offset.

In FIG. 8 corresponding to the flow measurement during a casting operation on ingot mold No. 2, the preceding circuit is brought into a relationship with the reservoir R2 via the flow meter FT3 and the isolating valve V3. Ingot mold No. 2 is isolated from R1 by closure of the valve VP2 and brought into a relationship with reservoir R2 via the valve VS2. An anomaly in respect of the measured flow rate indicates a failure of the ingot mold No. 2.

FIG. 9 corresponds to measurement after casting operation of head loss created by the slot of the ingot mold No. 3 under a gas flow rate of reference Dc.

This monitoring function is performed by isolating R1 as well as all the primary circuit, that is to say by closing V1, V3 and all the valves VP and by using only the source circuit R2.

The reference flow rate Dc is obtained by virtue of the flow regulator consisting of regulating valve FV2 and flow meter FT2 and is sent to ingot mold No. 3 via VS3, the only VS valve to be opened.

The pressure measured over PT2 is directly linked to the slot thickness. If this pressure is too great, then the thickness has to be adjusted or the slot has to be unclogged.

EXAMPLE OF APPLICATION

The invention may be illustrated by means of the following example:

On the basis of this method, a casting installation having 64 strands was constructed, making it possible to cast billets of different diameters of which the largest has a diameter of 254 mm. The distance between the vertical axes of two ingot molds next to the other is 400 mm.

The stacking of the various refractory parts and the constraints of metal supply led to the adoption of 210 mm as the height of the metal column above the overhang.

At the initial assembly of each ingot mold, the slot is regulated to a thickness of 0.075 mm. A double check is then carried out: a direct check on the thickness by using a set of wedges; an indirect check by measuring the head loss created by the slot at a flow rate of 200 Nl/h.

The installation has been prepared in view of casting a diameter of 254 mm. As the furnace capacity did not make it possible to feed 64 strands in this diameter, 20 strands were shut down.

Shutting down a strand consists on the one hand of occluding its metal inlet and on the other of closing the gas circuit which feeds it by the corresponding valve VP.

The ingot molds of all the strands in service were given a coating of grease, this lubrication being intended to meet the needs of the entire casting batch.

Prior to casting, a double check for leakage was carried out: the first check related to the primary circuit and revealed leaks of 17 Nl/h under 6.5 kPa pressure in the reservoir R1; the second check related to the secondary circuit and revealed leaks of 29 Nl/h under 6.5 kPa in reservoir R2.

As the leakage rates over the two circuits were considered acceptable, starting of the casting operation was authorized and a desired flow rate of 3.5 $Nm^3/h$ was applied to the primary gas circuit.

Once filling of the ingot molds was finished, the lift drop was started. Immediately afterwards, flow rate regulation was replaced by pressure regulation and the set point was rapidly raised to 6.2 kPa. After a short rest at this level, maintained up to 150 mm of cast length, the level was progressively reduced to 5.3 kPa at which level it was maintained until the drop ended.

One billet remained hung up in its ingot mold at start up and therefore the corresponding strand had to be shut off, both on the metal inlet side and on the gas supply side (the valve VP of this strand was shut down).

Casting followed over a length of 8.6 m.

The overall gas flow rate feeding the installation was kept under observation throughout the entire permanent operating situation. Only normal fluctuations were observed: having started at 2.33 $Nm^3/h$ at the moment of change over to permanent running, the flow rate then dropped to 1.84 $Nm^3/h$ then rose again very slightly at the end of casting to 1.97 $Nm^3/h$. This type of behavior is normal for casting a batch in this way with no continuous supply of lubricant and reflects scarcely perceptible fluctuations in the surface condition over all the cast billets. At the onset of casting, a slight inevitable degassing of the refractory parts in contact with the liquid metal gives the billets a very slightly roughened appearance. In the middle of casting, the surface appearance is completely smooth. At the end of casting, the lubricant film is deteriorated and very slight scratches appear on the surface of the billets. In fact, this roughness at the starting and finishing of casting operation causes the greater flow rate during these periods.

Three sets of individual flow rate checks on each strand were carried out respectively at 0.5 m, 4 m and 7.5 m of cast length. All the strands except four showed flow rates within the normal range, that is to say within the range from 30 Nl/h to 70 Nl/h. Strand No. 33 showed (on average over the three measurements) a flow rate of only 13 Nl/h. Strand No. 29 showed (on average over the three measurements) a flow rate of 94 Nl/h, strand No. 37 showed 386 Nl/h and strand No. 42 showed 122 Nl/h.

After casting operation, the billets were removed from the casting pit and inspected. Only those emanating from a strand where anomalies in the flow rate were found showed any surface defects. Slight laps were visible on billets Nos. 33 and 37. Billet No. 29, although nice and bereft of laps, showed small scratches, above all perceptible to the touch. Billet No. 42 had a quite marked vertical drag along one generatrix.

After casting, there was also a check on the head losses under a vacuum over each strand during a blank test. All the strands except Nos. 33 and 37 showed a head loss under 200 Nl/h within the normal range, that is to say within a range from 0.5 kPa to 1.5 kPa (head loss integrating that of the slot plus that of a portion of pipe work). The head loss in the case of strand No. 33 was abnormally high at 3.4 kPa while that of strand No. 37 was abnormally low at 0.35 kPa.

These results were analyzed as follows:

On account of the excessive head loss in the case of strand No. 33, the pressure behind the meniscus during the course of casting was markedly below the norm which is very close to the pressure in reservoir R1. Therefore, it was insufficient in order to push the meniscus back suitably. It was therefore normal to see slight laps appear on the surface of the billet and to measure a low flow rate during casting operation. As a function of this analysis, the decision was made to dismantle this ingot mold in order to perform a maintenance operation on it with a view to regenerating the slot thickness.

In the case of strand No. 37, the combination of a very low head loss and a high flow rate during the course of casting operation demonstrates that this strand suffered from a leakage problem upstream of the slot: all the gas did not manage to reach to behind the meniscus. As in the case of strand No. 33, but for a very different reason, viz. the presence of this leakage, the pressure behind the meniscus during casting operation was markedly below the normal level, very close to the pressure in the reservoir R1. Therefore, it was insufficient to push the meniscus back suitably. It was therefore normal to see slight laps appear on the surface of the billet. This time, the decision taken was to remedy the leakage problem on this strand.

A fresh ingot mold had been mounted on strand No. 29, in contrast to the other strands where the ingot molds fitted had already been used. As the working face of the ingot mold was still not properly ground in, it was normal for the billet surface to be a little rougher than usual and by reason of this the gas flow rate had been too high. As nothing abnormal was found concerning the slot by measuring the head loss, it was decided to pursue casting of batches with this ingot mold without taking any action, since the situation could be expected to improve very quickly on its own.

The very high flow rate found during casting operation on strand No. 42, combined with a normal head loss, demonstrates that this strand had a leakage problem downstream of the slot, that is to say at the level of the contact between ingot and mold. Indeed, the vertical drag on the billet surface opened up a leak of gas at the ingot/mold interface. With regard to the cause of the presence of the sticking point being the origin of the vertical drag, the hypothesis of metal penetrating the slot was put aside, the thickness of this latter being normal, to judge by the head loss. Undoubtedly, therefore, sticking was initiated by a defect in the working mold surface and the decision was taken to disconnect this ingot mold and replace it.

Therefore, this example illustrates that the method makes it possible:

to properly control all the points linked to the substantial density of ingot molds and to the heavy metallostatic charge which results;

to enjoy considerable flexibility in the management of casting operations;

to perform very many checks which individually or in combination constitute a considerable diagnostic aid against all the incidents which of necessity crop up in industrial life of a casting unit which has a large number of strands.

I claim:

1. A method for an automated injection of gas into an installation for multiple casting of metals comprising a plurality of ingot molds, each surmounted by an overhanging refractory header and supplied with liquid metal via a channel placed above said ingot molds so as to form a column of metal having a height between 200 and 250 mm measured from a base of the overhang, and a device for injecting the gas into each ingot mold all around the metal and just below said overhanging refractory header, by means of a horizontal slot having a thickness between 0.05 and 0.08 mm, said installation comprising a distance E, in mm, between vertical axes of two adjacent ingot molds and an inside diameter l, in mm, of the ingot molds, E and l satisfying the formula $140<(E-l)<200$, the device comprising:

a pressurized gas source connected to a primary reservoir R1 by means of a flow meter FT1 and a pressure regulating valve PV1, R1 being provided with a pressure gauge PT1;

a plurality of pipes emerging downstream of R1, each pipe being equipped with a valve VP and being connected to said horizontal slot;

a reservoir R2 connected to R1 by means of a flow meter FT3 introducing only negligible head loss, also connected to the pressurized gas source by means of a flow meter FT2 and a regulating valve FV2, and equipped with a pressure gauge PT2;

a plurality of pipes emerging from reservoir R2, each said pipe being equipped with a valve VSn and being connected to a corresponding pipe emerging from reservoir R1 at point situated downstream of a corresponding valve VP;

said method comprising:

a) prior to starting a casting operation, injecting gas into all ingot molds from reservoir R1, applying an overall fixed flow rate Dd by means of flow meter FT1 and regulating valve PV1 monitoring the pressure in reservoir R1 by means of pressure gauge PT1;

b) shortly after said starting a casting operation and gas injection, applying a pressure Pd by means of pressure gauge PT1 and regulating valve PV1, pressure Pd being slightly greater than pressure exerted by the column of metal;

c) during said casting operation, applying a pressure P by means of gauge PT1 and valve PV1, pressure P being smaller than pressure Pd and close to that exerted by the column of metal, monitoring the overall flow rate by means of flow meter FT1 in order to detect any sufficiently great anomaly to have an effect on said overall flow rate, and, on at least one occasion, measuring successively over each ingot mold taken in isolation, the gas flow rate by opening in turn each valve VS, while closing the corresponding valve VP, said gas flow rate being read on the flow meter FT3, making it possible to specify the origin of any anomaly previously detected by flow meter FT1 and to detect any strictly local anomaly; and d) after the casting operation, when there is no further counter-pressure of metal, monitoring on each ingot mold taken in isolation, the thickness of the slot by measuring the head loss created in relation to a reference flow rate, said measuring comprising isolating reservoir R2 from reservoir R1, connecting reservoir R2 to the source of gas by means of flow meter FT2 and valve FV2, regulating the flow rate at a fixed level Dc, opening successively each valve VSn and measuring in turn the pressure by means of the pressure gauge PT2;

and subsequently, before a further casting operation:

e) after isolating reservoir R1 from reservoir R2, closing all the valves VP, detecting a possible leakage on a primary part of the circuit directly connected to reservoir R1 by applying a pressure P' in reservoir R1 and by reading the flow rate on flow meter FT1; and f) after isolating reservoir R2 from reservoir R1, closing all the valves VS, detecting a possible leakage on a secondary part of the circuit by applying a pressure P' in reservoir R2 and by reading the flow rate on flow meter FT2.

2. A method according to claim 1, wherein the ingot moulds have a coating of grease only prior to casting.

3. A method for an automated injection of gas into an installation for multiple casting of metals comprising a plurality of ingot molds, each surmounted by an overhanging refractory header and supplied with liquid metal via a channel placed above said ingot molds so as to form a column of metal, and a device for injecting the gas into each ingot mold all around the metal and just below said overhanging refractory header by means of a horizontal slot, the device comprising:

a pressurized gas source connected to a primary reservoir R1 by means of a flow meter FT1 and a pressure regulating valve PV1, R1 being provided with a pressure gauge PT1;

a plurality of pipes emerging downstream of R1, each pipe being equipped with a valve VP and being connected to said horizontal slot;

a reservoir R2 connected to R1 by means of a flow meter FT3 introducing only negligible head loss, also connected to the pressurized gas source by means of a flow meter FT2 and a regulating valve FV2, and equipped with a pressure gauge PT2;

a plurality of pipes emerging from reservoir R2, each said pipe being equipped with a valve VSn and being connected to a corresponding pipe emerging from reservoir R1 at point situated downstream of a corresponding valve VP;

said method comprising:

a) prior to starting a casting operation, injecting gas into all ingot molds from reservoir R1, applying an overall fixed flow rate Dd by means of flow meter FT1 and regulating valve PV1 monitoring the pressure in reservoir R1 by means of pressure gauge PT1;

b) shortly after said starting a casting operation and gas injection, applying a pressure Pd by means of pressure gauge PT1 and regulating valve PV1, pressure Pd being slightly greater than pressure exerted by the column of metal;

c) during said casting operation, applying a pressure P by means of gauge PT1 and valve PV1, pressure P being smaller than pressure Pd and close to that exerted by the column of metal, monitoring the overall flow rate by means of flow meter FT1 in order to detect any sufficiently great anomaly to have an effect on said overall flow rate, and, on at least one occasion, measuring successively over each ingot mold taken in isolation, the gas flow rate by opening in turn each valve VS, while closing the corresponding valve VP, said gas flow rate being read on the flow meter FT3, making it possible to specify the origin of any anomaly previously detected by flow meter FT1 and to detect any strictly local anomaly; and d) after the casting operation, when there is no further counter-pressure of metal, monitoring on each ingot mold taken in isolation, the thickness of the slot by measuring the head loss created in relation to a reference flow rate, said measuring comprising isolating reservoir R2 from reservoir R1, connecting reservoir R2 to the source of gas by means of flow meter FT2 and valve FV2, regulating the flow rate at a fixed level Dc, opening successively each valve VSn and measuring in turn the pressure by means of the pressure gauge PT2;

and subsequently, before a further casting operation:

e) after isolating reservoir R1 from reservoir R2, closing all the valves VP, detecting a possible leakage on a primary part of the circuit directly connected to reservoir R1 by applying a pressure P' in reservoir R1 and by reading the flow rate on flow meter FT1; and f) after isolating reservoir R2 from reservoir R1, closing all the valves VS, detecting a possible leakage on a secondary part of the circuit by applying a pressure P' in reservoir R2 and by reading the flow rate on flow meter FT2.

4. A method according to claim 3, characterised in that the ingot moulds have a coating of grease only prior to casting.

* * * * *